US010648367B2

(12) United States Patent
Shiga et al.

(10) Patent No.: US 10,648,367 B2
(45) Date of Patent: May 12, 2020

(54) STEAM TURBINE DRAIN STRUCTURE AND METHOD OF MODIFYING THE SAME

(71) Applicant: Mitsubishi Hitachi Power Systems, Ltd., Yokohama-shi, Kanagawa (JP)

(72) Inventors: Takumi Shiga, Yokohama (JP); Naoto Kubo, Yokohama (JP)

(73) Assignee: Mitsubishi Hitachi Power Systems, Ltd., Yokohama (JP)

( * ) Notice: Subject to any disclaimer, the term of this patent is extended or adjusted under 35 U.S.C. 154(b) by 0 days.

(21) Appl. No.: 16/032,767

(22) Filed: Jul. 11, 2018

(65) Prior Publication Data

US 2019/0017416 A1 Jan. 17, 2019

(30) Foreign Application Priority Data

Jul. 12, 2017 (JP) ..... 2017-135886

(51) Int. Cl.
*F01D 25/32* (2006.01)
*F01K 7/38* (2006.01)
*F01K 13/00* (2006.01)

(52) U.S. Cl.
CPC ..... *F01D 25/32* (2013.01); *F01K 7/38* (2013.01); *F01K 13/006* (2013.01); *F05D 2220/31* (2013.01); *F05D 2260/602* (2013.01)

(58) Field of Classification Search
CPC ..... F01D 25/32; F01K 7/38; F01K 13/006
See application file for complete search history.

(56) References Cited

U.S. PATENT DOCUMENTS

| | | | | |
|---|---|---|---|---|
| 8,419,354 | B2 | 4/2013 | Sakai et al. | |
| 2007/0274824 | A1 | 11/2007 | Burdgick et al. | |
| 2015/0176435 | A1* | 6/2015 | Nagao | F01D 25/32 415/169.2 |

FOREIGN PATENT DOCUMENTS

| | | | | |
|---|---|---|---|---|
| GB | 387361 | A | 2/1933 | |
| JP | 61-182403 | A | 8/1986 | |
| JP | 7-150904 | A | 6/1995 | |
| JP | 10-18807 | A | 1/1998 | |
| JP | 3345509 | B2 | 11/2002 | |
| JP | 2004-124751 | A | 4/2004 | |
| JP | 3815143 | B2 | 8/2006 | |
| JP | 2009228617 | A * | 10/2009 | F01D 25/32 |
| JP | 2012-2135 | A | 1/2012 | |

(Continued)

OTHER PUBLICATIONS

Korean-language Office Action issued in counterpart Korean Application No. 10-2018-0078674 dated Aug. 5, 2019 (five (5) pages).

(Continued)

*Primary Examiner* — Woody A Lee, Jr.
(74) *Attorney, Agent, or Firm* — Crowell & Moring LLP

(57) ABSTRACT

A steam turbine drain structure includes a drain pocket for collecting drain water generated in a steam turbine, and a drain hole communicating with the lower side of the drain pocket. The steam turbine drain structure further includes a drain pan arranged below the exit of the drain hole and configured to collect drain water discharged from the drain hole, and a connection pipe one end of which is connected to the bottom portion of the drain pan and the other end of which is connectable to piping laid outside the steam turbine.

6 Claims, 4 Drawing Sheets

(56) References Cited

FOREIGN PATENT DOCUMENTS

JP 2012002135 A * 1/2012 ..... F01D 25/32

OTHER PUBLICATIONS

Extended European Search Report issued in counterpart European Application No. 18182972.2 dated Nov. 28, 2018 (five (5) pages).
Hindi-language Office Action issued in counterpart Indian Application No. 201814025917 dated Feb. 12, 2020 with English translation (five (5) pages).

* cited by examiner

STEAM TURBINE DRAIN STRUCTURE AND METHOD OF MODIFYING THE SAME

BACKGROUND OF THE INVENTION

1. Field of the Invention

The present invention relates to a steam turbine drain structure and a method of modifying the same.

2. Description of the Related Art

Generally speaking, in a steam turbine used in a nuclear power plant, a thermal power plant or the like, there is a region where operation is performed in a wet steam including water droplets. In the region, relatively large water droplets on the order of several tens of micrometers or more may be formed in blade wake. In particular, at tip portions of final stage moving blades of the steam turbine, wetness fraction of the steam is high, and the peripheral speed is high, so that such coarse water droplets frequently impinge upon the blade surfaces at high speed, resulting in an environment where erosion is likely to be generated. As the countermeasures against the erosion, there have been proposed various structures for capturing, removing, and separating the water droplets.

For example, JP-2012-2135-A discloses a steam turbine casing structure having a turbine casing accommodating a plurality of nozzles and moving blades and forming a steam path therein, and an outer ring fixed to the turbine casing and fixedly supporting the nozzles. In the steam turbine casing structure, there is formed between the turbine casing and the outer ring a drain pocket which is a ring-like space, and there is provided in the outer periphery of the steam path and on the downstream side of the final stage nozzles and on the upstream side of the final stage moving blades a water droplet collection slit establishing communication between the drain pocket and the steam path. In the steam turbine casing structure, the water droplets (drain water) generated due to heat drop at the final stage nozzles are collected in the drain pocket via the water droplet collection slit and is suctioned by a vacuum suction device to be collected, with the drain water being discharged outside the steam turbine due to its own weight via a discharge hole provided in the lower portion of the ring-like drain pocket.

In a steam turbine drain method, drain water is disposed of by being discharged directly outside and around a steam turbine via a discharge hole provided in a turbine casing as in the case of the steam turbine casing structure disclosed in JP-2012-2135-A. In another drain method, drain water is disposed of by being discharged into plant piping laid outside a steam turbine via a line or the like provided in a turbine casing or the like.

When performing replacement on steam turbines differing in the drain method as described above, there is a case where the number of the work steps for the steam turbine replacement increases and the work period is elongated due to the difference in the drain method. More specifically, when replacing a steam turbine having the structure in which drain water is discharged into plant piping laid outside the steam turbine by a steam turbine having the structure in which drain water is discharged directly outside and around the steam turbine via a discharge hole of a turbine casing, the piping for drain disposal outside the steam turbine becomes unnecessary, so that the existing piping needs to be removed.

Thus, due to the removal of the existing piping, the number of the work steps on site increases, and the work period on site is elongated.

SUMMARY OF THE INVENTION

The present invention has been made in order to solve the above problem. It is an object of the present invention to provide a steam turbine drain structure and a method of modifying the same which help to shorten work process and work period on site in the replacement work for replacing a steam turbine having the structure in which drain water collected is discharged into piping laid in a plant by a steam turbine having the structure in which drain water collected is discharged directly outside the steam turbine via a discharge hole provided in a turbine casing.

The present application includes a plurality of means for solving the above problem, one aspect of which is a steam turbine drain structure including a drain pocket defined by part of a stationary assembly accommodating a rotary assembly and extending in a circumferential direction, and at least one drain hole provided in a lower side portion of the stationary assembly so as to communicate with a lower side of the drain pocket. The steam turbine drain structure further includes a drain pan arranged below an exit of the at least one drain hole and configured to collect drain water discharged from the at least one drain hole, and a connection pipe one end of which is connected to a bottom portion of the drain pan and the other end of which is connectable to piping laid outside a steam turbine.

According to the present invention, the drain pan for collecting drain water is arranged below the exit of the drain hole, and one end of the connection pipe that is connectable to the piping laid outside the steam turbine is connected to the bottom portion of the drain pan, so that it is possible to dispose of the drain water collected in the drain pocket by discharging the drain water into the piping outside the steam turbine successively via the drain hole, the drain pan, and the connection pipe. Therefore, in the work of replacing a steam turbine having the structure in which drain water collected is discharge into piping laid in the plant by a steam turbine having the structure in which drain water collected is discharged outside the steam turbine via the discharge hole of the stationary assembly, it is possible to utilize the existing piping outside the steam turbine as the piping for drain disposal by modifying the drain structure of the replacement steam turbine, so that there is no need to remove the existing piping outside the steam turbine, making it possible to shorten the work process and the work period on site.

Other problems, structure, and effects will become apparent from the following description of the embodiments.

DESCRIPTION OF THE PREFERRED EMBODIMENTS

In the following, steam turbine drain structures and methods of modifying the same according to embodiments of the present invention will be described with reference to the drawings.

First Embodiment

Figure 1:
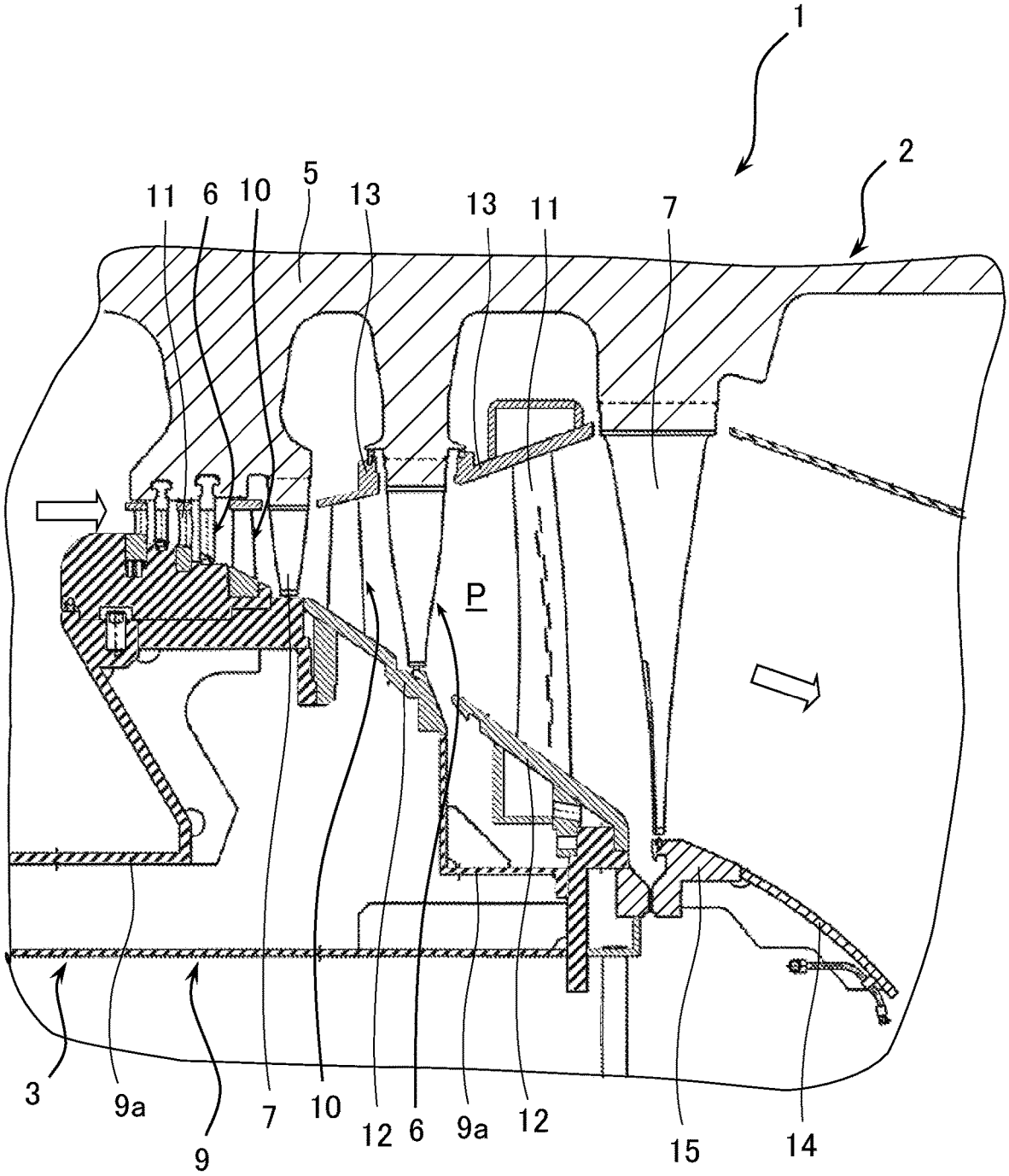
FIG. 1 is a longitudinal sectional drawing illustrating a structure of a main portion of a steam turbine to which a steam turbine drain structure according to a first embodiment of the present invention is applied.

First, a configuration of a steam turbine to which a steam turbine drain structure according to a first embodiment of the present invention is applied will be described with reference to FIG. 1. FIG. 1 is a longitudinal sectional drawing illustrating a structure of a main portion of the steam turbine to which the steam turbine drain structure according to the first embodiment of the present invention is applied. In FIG. 1, hollow arrows indicate the flow of steam.

In FIG. 1, a steam turbine 1 includes a rotary assembly 2, and a stationary assembly 3 accommodating the rotary assembly 2. The rotary assembly 2 has a rotor shaft 5 rotatably supported by the stationary assembly 3, and a plurality of moving blade rows 6 arranged in the axial direction of the rotor shaft 5. Each of the moving blade rows 6 is composed of a plurality of moving blades 7 arranged in the circumferential direction in the outer peripheral portion of the rotor shaft 5.

The stationary assembly 3 includes a turbine casing 9 containing the rotor shaft 5 and the moving blade rows 6, and a plurality of nozzle rows 10 arranged upstream of each moving blade row 6. The turbine casing 9 is divided, for example, into a casing upper half part (not shown) and a casing lower half part 9*a*. Each of the nozzle rows 10 is composed of a plurality of nozzles 11 arranged in the circumferential direction on the inner circumferential side of the turbine casing 9. The radially outer end of each nozzle 11 is fixed to an annular outer ring 12 by welding or the like, and the radially inner end of each nozzle 11 is fixed to an annular shroud 13 by welding or the like. The outer ring 12 and the shroud 13 are divided, for example, into a plurality of segments. Each segment of the outer ring 12 is mounted to the turbine casing 9 by fixation means such as bolts (not shown).

In the area inside the turbine casing 9 where the moving blade rows 6 and the nozzle rows 10 are arranged, there is formed an annular flow path P through which steam passes. That is, the annular flow path P is defined by the inner peripheral surface of the turbine casing 9, the inner peripheral wall surface of the outer ring 12, the outer peripheral surfaces of the root portions of the moving blades 7, the outer peripheral surface of the shroud 13, etc.

One moving blade row 6 and one nozzle row 10 on the upstream side of the moving blade row 6 constitute one stage. That is, the steam turbine 1 includes a plurality of stages (five stages in FIG. 1). On the outer peripheral end side and on the downstream side of the final stage moving blade row 6, there is arranged a flow guide 14 configured to smoothly guide steam flowing out of the final stage moving blade row 6 to an exhaust chamber (not shown). The flow guide 14 is mounted to a collector ring 15 by welding or the like, and is fixed to a part of the stationary assembly 3 such as the turbine casing 9 via the collector ring 15.

Downstream of the steam turbine 1, there is usually arranged a condenser (not shown) configured to condense the steam discharged from the steam turbine 1 to convert it to water. Further, connected to the steam turbine 1 is a load, for example, of a generator or a compressor, via the rotor shaft 5.

Figure 2:
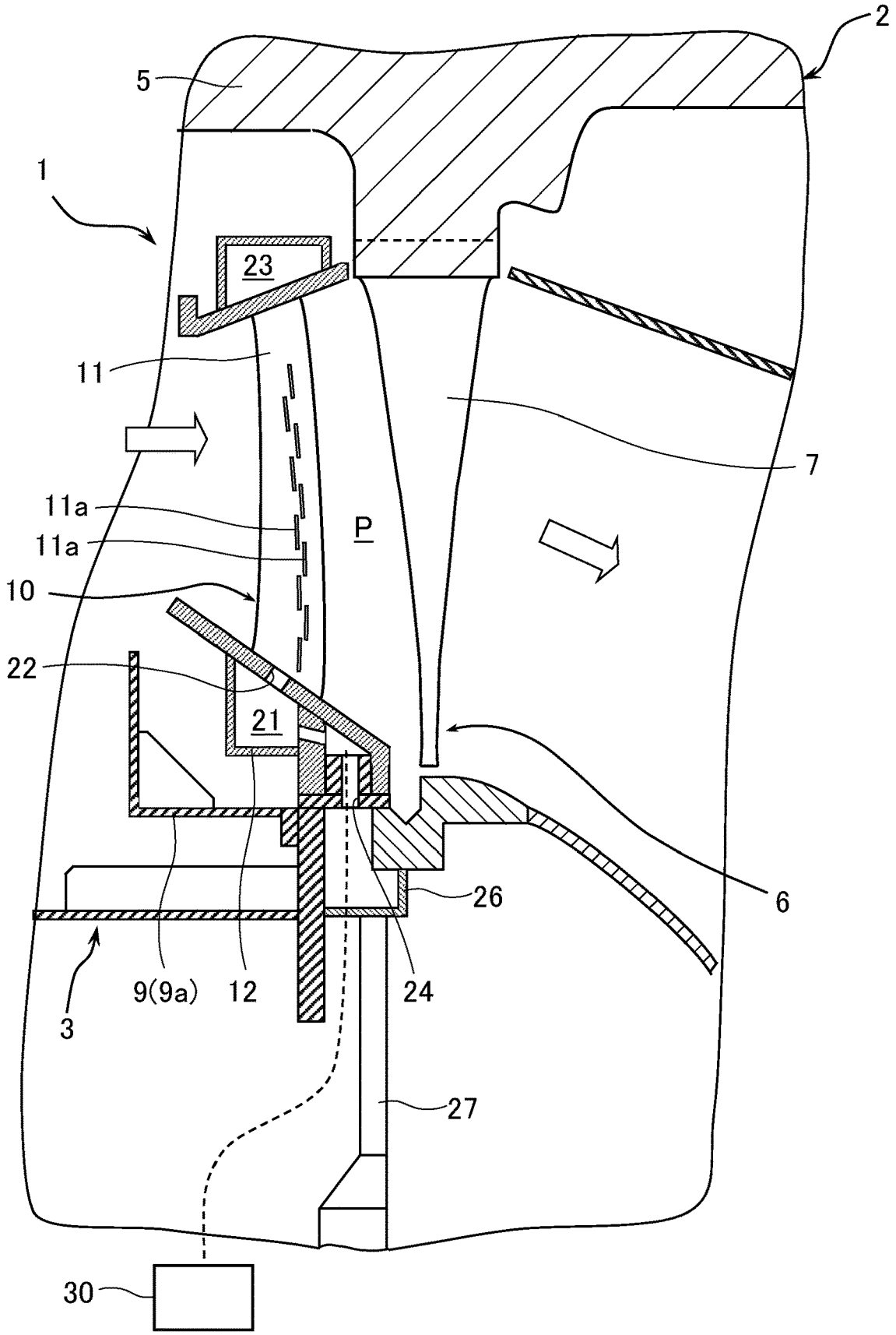
FIG. 2 is an enlarged sectional drawing illustrating the steam turbine drain structure according to the first embodiment of the present invention shown in FIG. 1.

Next, the steam turbine drain structure according to the first embodiment of the present invention will be described with reference to FIG. 2. FIG. 2 is an enlarged sectional drawing illustrating the steam turbine drain structure according to the first embodiment of the present invention shown in FIG. 1. In FIG. 2, hollow arrows indicate the flow of the steam. In FIG. 2, the components that are the same as those of FIG. 1 are indicated by the same reference characters, and a detailed description thereof will be left out.

The steam turbine drain structure according to the first embodiment of the present invention is applied to the structure of the final stage. This is due to the fact that at the tip portions of the moving blades 7 of the final stage, the wetness fraction of the steam is high, and the peripheral speed is high, so that the water droplets (drain water) frequently impinge upon the blade surfaces at high speed, resulting in an environment where erosion is likely to be generated. The steam turbine drain structure according to the present invention, however, is also applicable to a structure other than the final stage.

More specifically, each of the nozzles 11 of the final stage has a hollow portion (not shown) therein, and the hollow portion of the nozzle 11 communicates with a hollow portion 21, described below, of the outer ring 12. Further, in the nozzle surface of each nozzle 11 of the final stage, there are provided at radial intervals a plurality of drain grooves 11*a* extending in the radial direction. Further, there are provided a plurality of rows (two rows in FIG. 2) of drain grooves 11*a* in the flow direction of the steam, and the drain grooves 11*a* of the upstream side row and the drain grooves 11*a* of the downstream side row are arranged so as to be alternately deviated in the radial direction. The drain grooves 11*a* of the nozzle 11 communicate with the hollow portion of the nozzle 11.

The outer ring 12 fixing the final stage nozzle row 10 to the turbine casing 9 has a hollow portion 21 therein. In the inner peripheral wall of the outer ring 12, there are provided a plurality of through-holes 22 along the circumferential direction. The through-holes 22 communicate with the hollow portion 21 of the outer ring 12. The hollow portion 21 of the outer ring 12 functions as a drain pocket configured to collect drain water generated due to the heat drop when the steam passes through the final stage nozzle row 10. That is, the drain pocket is a space extending in the circumferential direction, for example, an annular space. Connected to the hollow portion 21 of the outer ring 12 is a vacuum suction device 30 for sucking the drain water collected. The shroud 13 mounted to the inner peripheral end of the final stage nozzle row 10 has a hollow portion 23 therein, and the hollow portion 23 communicates with the hollow portion of each nozzle 11 of the final stage.

Of the portion of the turbine casing 9 to which the outer ring 12 is fixed, in the lower side portion of the casing lower half part 9*a*, there are provided a plurality of drain holes 24 (only one of them is shown in FIG. 2) at circumferential intervals. The drain holes 24 communicate with the lower side of the hollow portion 21 of the outer ring 12. Below the exits of the drain holes 24, there is arranged a drain pan 26 configured to collect drain water discharged from the drain holes 24. The drain pan 26 is a member of an arcuate configuration as seen from the axial direction of the rotor shaft 5. The drain pan 26 extends from a drain hole 24 at one end in the circumferential direction of the plurality of drain holes 24 to a drain hole 24 at the other end. One end of a connection pipe 27 is connected to the bottom portion of the drain pan 26. The other end of the connection pipe 27 is connectable to piping (not shown) laid in the plant outside the steam turbine.

Next, the operation of the steam turbine drain structure according to the first embodiment of the present invention will be described with reference to FIGS. 1 and 2.

As shown in FIG. 1, the steam as the working fluid introduced into the annular flow path P alternately passes through a plurality of nozzle rows 10 and moving blade rows 6. After this, the steam flows out from the final stage moving blade row 6 to the exhaust chamber (not shown) along the flow guide 14 to be eventually guided to a condenser (not shown). When passing through the nozzle rows 10, the steam is accelerated due to conversion of the thermal energy thereof to kinetic energy. After this, when the steam passing through the moving blade rows 6, part of the kinetic energy of the steam is converted to rotational torque of the moving blades 7, and the load connected to the rotor shaft 5 is rotated.

When passing through the final stage nozzle row 10 shown in FIG. 2, the steam decreases in temperature due to heat drop, and part of the steam is condensed into water droplets (drain water) of a relatively small grain size. Most of the water droplets impinge upon the surfaces of the nozzles 11 and the inner peripheral wall surface of the outer ring 12 to adhere thereto. The water droplets adhering to the surfaces of the nozzles 11, etc. are accumulated to form a water film.

In the case of a steam turbine without a structure for the capturing, removal, separation, etc. of the above-mentioned water droplets and water film, the above-mentioned water film moves to the downstream side on the surfaces of the nozzles, etc., and is dispersed from the downstream edge thereof as water droplets of a relatively large grain size. The dispersed water droplets impinge upon the final stage moving blade row situated downstream of the final stage nozzle row, causing erosion to the surfaces of the moving blades and wetness loss hindering the rotation of the moving blades.

In contrast, in the present embodiment, the pressure in the annular flow path P is higher than the pressure in the hollow portion 21 of the outer ring 12, so that the drain water (water film) on the surface of the final stage nozzle 11 is sucked by the drain grooves 11*a*, and is collected in the hollow portion 21 of the outer ring 12 as the drain pocket via the hollow portion of the nozzle 11. The drain water (water film) on the inner peripheral wall surface of the outer ring 12 to which the final stage nozzles 11 are mounted is collected in the drain pocket 21 via the through-holes 22.

Part of the drain water collected in the drain pocket 21 is sucked and collected by the vacuum suction device 30. The remaining of the drain water collected in the drain pocket 21 is discharged from the drain holes 24 provided on the lower side of the drain pocket 21 due to its own weight, and is collected by the drain pan 26. The drain water collected by the drain pan 26 is disposed of by being discharged via the connection pipe 27 into the piping (not shown) of the plant laid outside the steam turbine.

In this way, in the present embodiment, the drain water generated at the time of the passing of the final stage nozzle row 10 is collected in the drain pocket 21 in the outer ring 12, and can be reliably disposed of by being discharged into the plant piping successively via the drain holes 24, the drain pan 26, and the connection pipe 27. That is, it is possible to avoid discharging the drain water collected in the drain pocket 21 directly outside and around the steam turbine via the drain holes 24 of the turbine casing 9.

In a steam turbine drain method, the collected drain water is discharged into the plant piping laid outside the steam turbine, as in the case of the steam turbine 1 shown in FIG. 2. On the other hand, there is a method according to which the collected drain water is discharged directly outside and around the steam turbine from the drain holes provided in the casing of the steam turbine.

Figure 3:
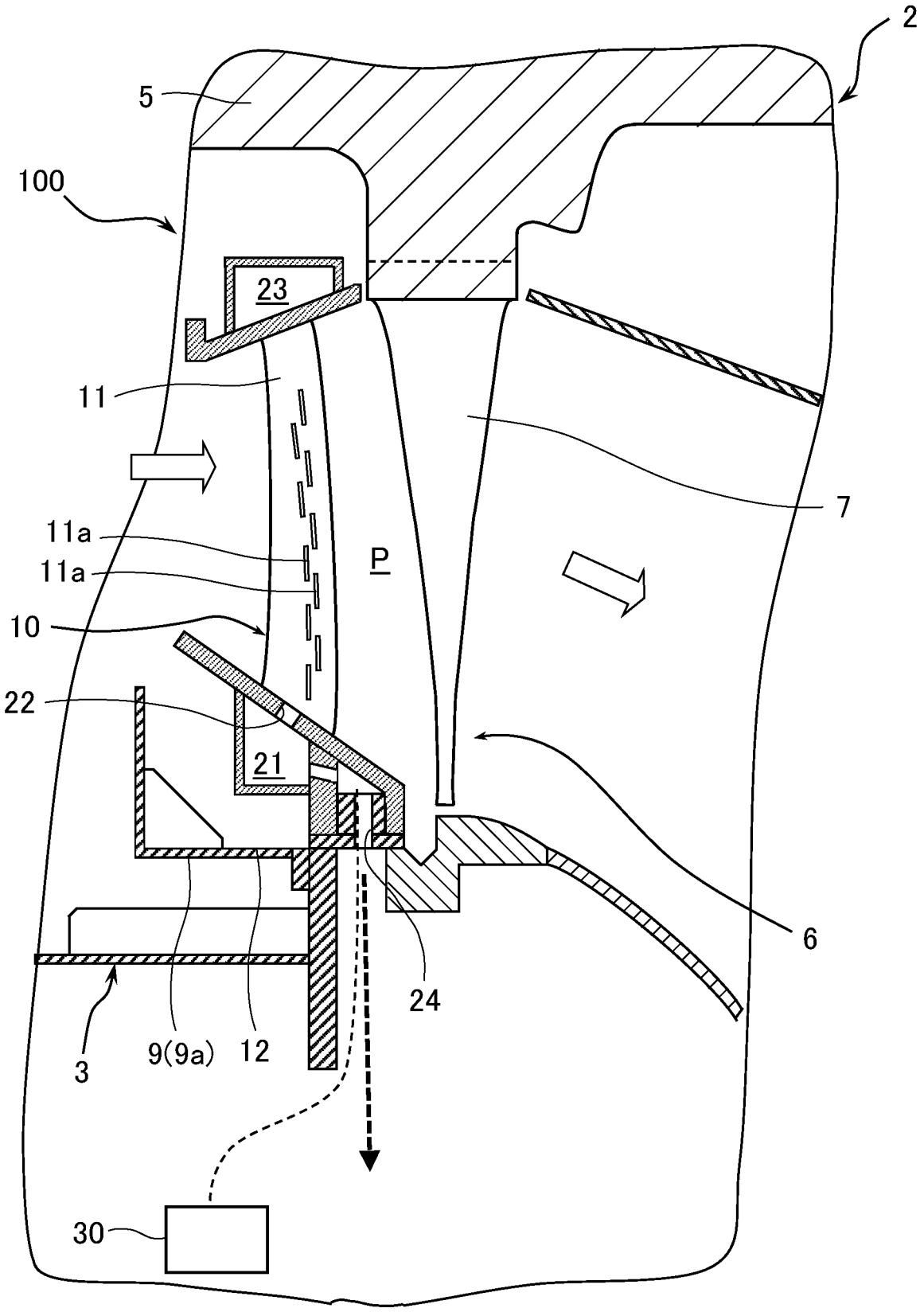
Fig. 3 (PRIOR ART)
FIG. 3 is a sectional drawing illustrating a conventional steam turbine drain structure in which collected drain water is discharged directly outside and around the steam turbine.

Next, the conventional steam turbine drain structure in which the collected drain water is discharged directly outside and around the steam turbine will be described with reference to FIG. 3. FIG. 3 is a sectional drawing illustrating the conventional steam turbine drain structure in which the collected drain water is discharged directly outside and around the steam turbine. In FIG. 3, hollow arrows indicate the flow of steam, and a dotted arrow indicates the flow of drain water. In FIG. 3, the components that are the same as those of FIGS. 1 and 2 are indicated by the same reference characters, and a detailed description thereof will be left out.

More specifically, as shown in FIG. 3, the conventional steam turbine 100 is equipped with a drain structure including the drain pocket 21 that is the annular space formed inside the outer ring 12 and the plurality of drain holes 24 provided in the lower side portion of the turbine casing 9 so as to communicate with the lower side of the drain pocket 21. However, the drain structure of the conventional steam turbine 100 does not include the drain pan 26 and the connection pipe 27 of the steam turbine 1 shown in FIG. 2. Thus, in the conventional steam turbine 100 shown in FIG. 3, the drain water collected in the drain pocket 21 is discharged directly outside and around the steam turbine from the plurality of drain holes 24 provided in the lower side portion of the turbine casing 9 due to its own weight, as shown by the dotted arrow. That is, unlike the steam turbine 1 shown in FIG. 2, in the conventional steam turbine 100, there is no need to provide the plant piping for disposing of the drain water discharged from the steam turbine.

When performing replacement on steam turbines differing in drain method as described above, the replacement work of the steam turbines may increase in work steps and in work period due to difference in drain method. More specifically, in the case where a steam turbine having the structure in which drain water is discharged into the plant piping laid outside the steam turbine is replaced by the conventional steam turbine 100 in which drain water is simply discharged outside and around the steam turbine from the drain holes 24 provided in the turbine casing 9, it is necessary to remove the existing piping outside the steam turbine. The removal of the existing piping causes the number of the work steps on site to increase and the work period on site to be elongated.

In contrast, in the case where a steam turbine is replaced by a steam turbine having the drain structure of the present embodiment, it is possible to utilize the existing plant piping for drain disposal. More specifically, the existing plant piping is partially modified such that it is allowed to be connected to one end of the connection pipe 27 connected to the drain pan 26. As a result, it is possible to dispose of drain water collected in the drain pocket 21 by discharging the drain water into the plant piping sequentially via the drain holes 24, the drain pan 26, and the connection pipe 27. As compared with the case where a steam turbine is replaced by the conventional steam turbine 100, there is no need to remove the existing piping for drain disposal, so that it is possible to shorten the work process the work period on site.

As described above, in the case where a steam turbine having the structure in which drain water is discharged into the plant piping laid outside the steam turbine is replaced by the conventional steam turbine 100 in which drain water is simply discharged outside and around the steam turbine from the drain holes 24, the removal of the existing piping causes the number of the work steps for the replacement to increase and the work period to be elongated. In this case, prior to the replacement work, the drain structure of the conventional turbine 100 is previously modified to the steam turbine drain structure according to the first embodiment of the present invention in a factory, whereby it is possible to shorten the work process and the work period on site.

More specifically, in the drain structure of the steam turbine 100, shown in FIG. 3, including the drain pocket 21 formed inside the outer ring 12 and the drain holes 24 provided in the lower side portion of the turbine casing 9 so as to communicate with the lower side of the drain pocket 21, the work is performed to arrange a drain pan 26 below the exits of the drain holes 24. The drain pan 26 is configured to collect drain water discharged from the drain holes 24. Further, the work is performed to connect one end of the connection pipe 27, the other end of which being connectable to the plant piping, to the bottom portion of the drain pan 26. In this way, it is possible to modify the drain structure of the conventional steam turbine 100 into a structure similar to the drain structure of the steam turbine 1 shown in FIG. 2.

In the case of replacement by a steam turbine having the drain structure thus modified (the drain structure shown in FIG. 2), drain water collected in the drain pocket 21 can be discharged into the plant piping outside the steam turbine successively via the drain holes 24, the drain pan 26, and the connection pipe 27. It is possible to utilize the existing piping of the plant as the piping for drain disposal, so that there is no need to remove the existing piping of the plant, and it is possible to reduce the number of the work steps on site and to shorten the work period on site.

As described above, in the steam turbine drain structure and the method of modifying the same according to the first embodiment of the present invention, the drain pan 26 for collecting drain water is arranged below the exits of the drain holes 24, and one end of the connection pipe 27 that is connectable to the piping laid outside the steam turbine is connected to the bottom portion of the drain pan 26, so that it is possible to dispose of drain water collected in the drain pocket 21 by discharging the drain water into the piping outside the steam turbine via the drain holes 24, the drain pan 26, and the connection pipe 27. Therefore, in the replacement work of a steam turbine having the structure in which the collected drain water is discharged into the piping laid in the plant by a steam turbine having the structure in which the collected drain water is discharged directly outside the steam turbine via the drain holes 24 of the turbine casing 9 (the stationary assembly 3), it is possible to utilize the existing piping outside the steam turbine as the piping for drain disposal by modifying the drain structure of the replacement steam turbine, so that there is no need to remove the existing piping outside the steam turbine, making it possible to shorten the work process and the work period on site.

Further, in the present embodiment, the drain pan 26 is a member extending from the drain hole 24 at one end in the circumferential direction of the drain holes 24 to the drain hole 24 at the other end in correspondence with the plurality of drain holes 24 provided along the circumferential direction, so that all the drain water discharged from the plurality of drain holes 24 can be collected by the drain pan 26. Thus, there is no fear of the collected drain water being discharged directly outside and around the steam turbine via the drain holes 24.

Furthermore, in the present embodiment, the hollow portion 21 of the outer ring 12 is utilized as the drain pocket, so that there is no need to separately secure a space for the drain pocket, thus allowing effective utilization of the space.

Second Embodiment

Figure 4:
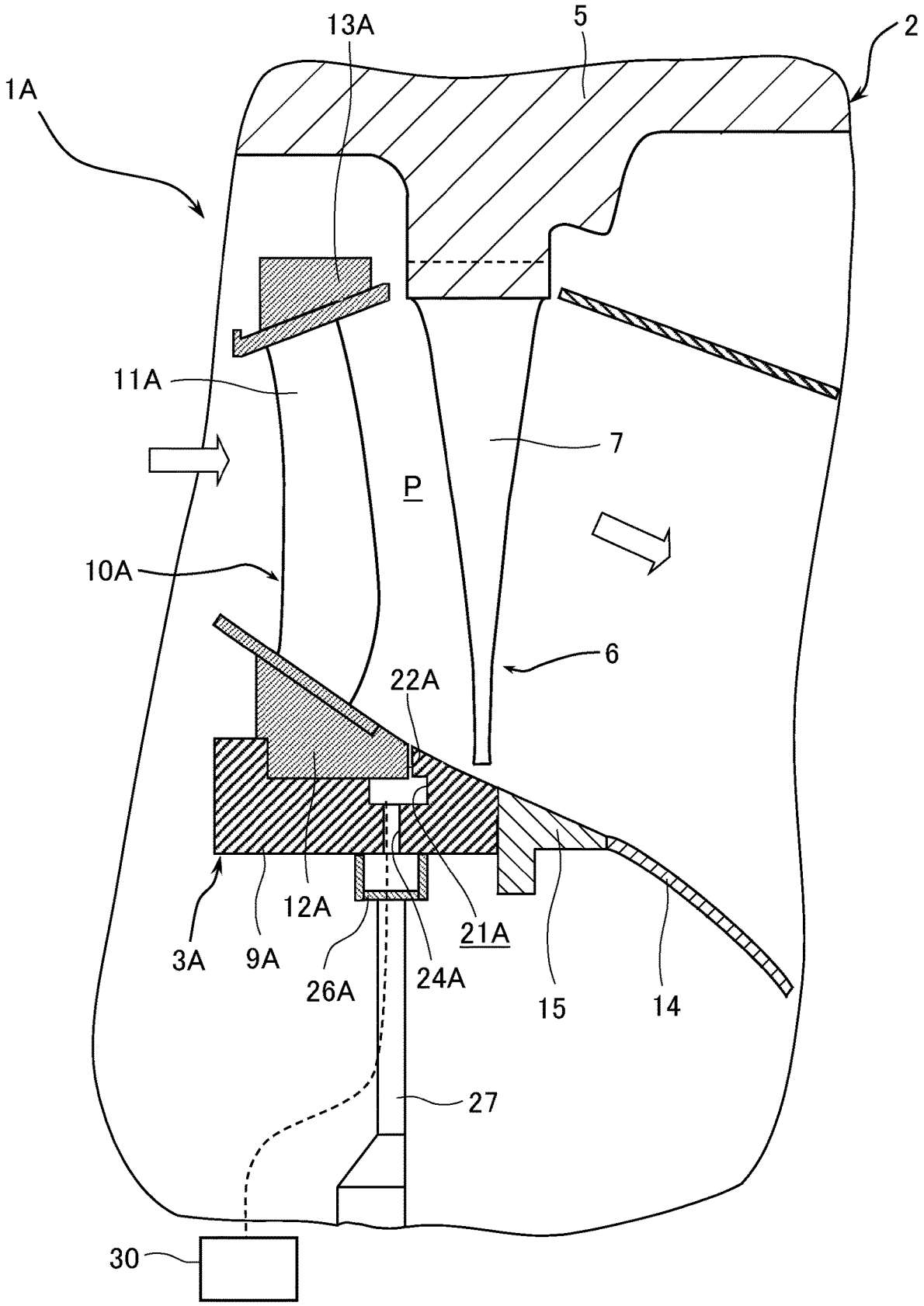
FIG. 4 is a sectional drawing illustrating a steam turbine drain structure according to a second embodiment of the present invention.

Next, a steam turbine drain structure according to a second embodiment of the present invention will be described with reference to FIG. 4. FIG. 4 is a sectional drawing illustrating the steam turbine drain structure according to the second embodiment of the present invention. In FIG. 4, hollow arrows indicate the flow of steam. In FIG. 4, the components that are the same as those of FIGS. 1 through 3 are indicated by the same reference characters, and a detailed description thereof will be left out.

In the first embodiment, the hollow portion 21 of the outer ring 12 is used as the drain pocket, whereas in the steam turbine drain structure according to the second embodiment of the present invention shown in FIG. 4, a drain pocket 21A is defined by wall surfaces of two members of an outer ring 12A and a turbine casing 9A which are part of stationary assembly 3A.

More specifically, unlike the first embodiment, each of the final stage nozzles 11A has no hollow portion therein, nor does it have a drain groove. Further, unlike the first embodiment, the outer ring 12A and the shroud 13A of the final stage have no hollow portions. Further, no through-holes are formed in the inner peripheral wall of the outer ring 12A of the final stage.

Between the final stage outer ring 12A and the turbine casing 9A, there is defined a drain pocket 21A extending in the circumferential direction. That is, the drain pocket 21A is defined by the wall surface of the turbine casing 9A and the wall surface of the outer ring 12A of the final stage. On the outer circumferential side of the annular flow path P between the nozzle row 10A of the final stage and the moving blade row 6 of the final stage, there is formed a slit 22A establishing communication between the drain pocket 21A and the annular flow path P. The slit 22A is formed in an annular configuration by setting the side wall on the downstream side of the steam flow of the final stage outer ring 12A and the side wall of the turbine casing 9A opposite each other.

In the lower side portion of the turbine casing 9A defining the drain pocket 21A, there are provided a plurality of drain holes 24A (only one of them is shown in FIG. 4) at circumferential intervals. The drain holes 24A communicate with the lower side of the drain pocket 21A. Below the exits of the drain holes 24A, there is arranged a drain pan 26A configured to collect drain water discharged from the drain holes 24A. The drain pan 26A is a member of an arcuate configuration as seen from the axial direction of the rotor shaft 5, and the drain pan 26A extends from a drain hole 24A at one end in the circumferential direction of the drain holes 24A to a drain hole 24A at the other end. As in the first embodiment, one end of the connection pipe 27 is connected to the bottom portion of the drain pan 26A, and the other end of the connection pipe 27 is connectable to the plant piping (not shown) outside the steam turbine.

In the present embodiment, the water droplets (drain water) generated due to heat drop when the steam passing through the final stage nozzle row 10A is collected in the drain pocket 21A via the slit 22A formed downstream of the final stage nozzle row 10A. As in the case of the first embodiment, part of the drain water collected in the drain pocket 21A is sucked and collected by the vacuum suction device 30. As in the first embodiment, the remaining drain water is discharged from the drain holes 24A due to its own weight, and is collected by the drain pan 26A. The drain water collected by the drain pan 26A is disposed of by being discharged into the piping (not shown) of the plant outside the steam turbine via the connection pipe 27.

Even in the case where the drain pocket 21A is thus defined by the outer ring 12A and the turbine casing 9A, the drain water collected in the drain pocket 21A can be discharged into the piping of the plant outside the steam turbine successively via the drain holes 24A, the drain pan 26A, and the connection pipe 27. Thus, as in the first embodiment, it is possible to avoid the drain water from being discharged directly outside and around the turbine casing.

In the case where a steam turbine having the structure in which the collected drain water is discharged into the plant piping outside the steam turbine is to be replaced by the steam turbine 1A having the drain structure of the present embodiment, it is possible to utilize the existing plant piping for drain disposal, so that it is possible to shorten the work process and the work period on site as compared with the case of the replacement work by the conventional steam turbine 100 in which it is necessary to remove the existing piping.

Further, the steam turbine drain structure which includes the drain pocket 21A defined by the outer ring 12A and the turbine casing 9A and the plurality of drain holes 24A provided in the lower side portion of the turbine casing 9A so as to communicate with the lower side of the drain pocket 21A and in which drain water is discharged directly outside and around the steam turbine from the drain holes 24A can be modified such that the drain pan 26A is arranged below the exits of the drain holes 24A and that the connection pipe 27 is connected to the bottom portion of the drain pan 26A. In this case, the collected drain water can be discharged into the piping of the plant outside the steam turbine.

As described above, in the steam turbine drain structure and the method of modifying the same according to the second embodiment of the present invention, it is possible to attain the same effect as that in the first embodiment even in the case where the drain pocket 21A is defined by the outer ring 12A and the turbine casing 9A.

Other Embodiments

The present invention is not limited to the first and second embodiments described above but includes various modifications. The above-described embodiments, which have been described in detail in order to facilitate the understanding of the present invention, are not always limited to the structures equipped with all the components mentioned above. For example, a part of the structure of a certain embodiment can be replaced by the structure of another embodiment. Further, the structure of another embodiment can be added to the structure of a certain embodiment. Further, with respect to a part of the structure of each embodiment, addition, deletion, or replacement of another structure is possible.

For example, while in the first and second embodiments described above the drain pocket is defined by the hollow portion 21 of the outer ring 12 or by the outer ring 12A and the turbine casing 9A, the drain pocket can be defined by using any part of the stationary assembly 3 so long as it is possible to collect the water droplets (drain water) generated at the time of passing through the nozzle rows or the moving blade rows.

What is claimed is:

1. A drain structure of a steam turbine, comprising:

a drain pocket defined by part of a stationary assembly accommodating a rotary assembly, the drain pocket extending in a circumferential direction;

at least one drain hole provided in a lower side portion of the stationary assembly so as to communicate with a lower side of the drain pocket;

a drain pan arranged below an exit of the at least one drain hole, the drain pan being configured to collect drain water discharged from the at least one drain hole; and a connection pipe one end of which is connected to a bottom portion of the drain pan and other end of which is connectable to piping laid outside the steam turbine.

2. The drain structure according to claim 1, wherein the at least one drain hole comprises a plurality of drain holes, the plurality of drain holes being provided along a circumferential direction of the stationary assembly, and the drain pan is a member extending from a drain hole at one end in the circumferential direction of the plurality of drain holes to a drain hole at other end.

3. The drain structure according to claim 1, wherein the stationary assembly includes a turbine casing accommodating the rotary assembly, a plurality of nozzles arranged on an inner circumferential side of the turbine casing, and an annular outer ring fixed to the turbine casing and supporting the plurality of nozzles, the drain pocket is a hollow portion formed inside the outer ring, and the at least one drain hole is provided in a portion of the turbine casing to which the outer ring is fixed.

4. The drain structure according to claim 1, wherein the stationary assembly includes a turbine casing accommodating the rotary assembly, a plurality of nozzles arranged on an inner circumferential side of the turbine casing, and an annular outer ring fixed to the turbine casing and supporting the plurality of nozzles, the drain pocket is a space defined by the turbine casing and the outer ring, and the lower side portion of the stationary assembly in which the at least one drain hole is provided is a lower side portion of the turbine casing defining the drain pocket.

5. A method of modifying a drain structure of a steam turbine, the drain structure comprising:

a drain pocket defined by part of a stationary assembly accommodating a rotary assembly, the drain pocket extending in a circumferential direction; and at least one drain hole provided in a lower side portion of the stationary assembly so as to communicate with a lower side of the drain pocket, the at least one drain hole being configured to discharge drain water collected in the drain pocket outside the steam turbine, the method comprising:

arranging a drain pan below an exit of the at least one drain hole, the drain pan being configured to collect drain water discharged from the at least one drain hole; and connecting one end of a connection pipe to a bottom portion of the drain pan, other end of the connection pipe being connectable to piping laid outside the steam turbine.

6. The method of modifying the drain structure according to claim 5, wherein the at least one drain hole comprises a plurality of drain holes, the plurality of drain holes being provided along a circumferential direction of the stationary assembly, and the drain pan is a member extending from a drain hole at one end in the circumferential direction of the plurality of drain holes to a drain hole at other end.

* * * * *